US011186436B2

(12) United States Patent
Lipof

(10) Patent No.: US 11,186,436 B2
(45) Date of Patent: Nov. 30, 2021

(54) SELF-LOADING RECEPTACLE LINER APPARATUS

(71) Applicant: Andrea Lipof, Newton, MA (US)

(72) Inventor: Andrea Lipof, Newton, MA (US)

( * ) Notice: Subject to any disclaimer, the term of this patent is extended or adjusted under 35 U.S.C. 154(b) by 174 days.

(21) Appl. No.: 16/773,294

(22) Filed: Jan. 27, 2020

(65) Prior Publication Data

US 2020/0239228 A1 Jul. 30, 2020

Related U.S. Application Data

(60) Provisional application No. 62/796,848, filed on Jan. 25, 2019.

(51) Int. Cl.
*B65F 1/06* (2006.01)

(52) U.S. Cl.
CPC ..... *B65F 1/062* (2013.01); *B65F 1/065* (2013.01); *B65F 1/067* (2013.01)

(58) Field of Classification Search
CPC ..... B65F 1/062; B65F 1/002; B65F 1/067; B65F 1/0013; F16B 2/08; F16B 2/06; F16B 2/20; F16B 2/24; F16B 2/245
See application file for complete search history.

(56) References Cited

U.S. PATENT DOCUMENTS 4,417,669 A 11/1983 Knowles et al.
5,113,637 A 5/1992 Gelbard
5,190,252 A * 3/1993 Schrager ..... B65F 1/06 248/97
5,238,139 A * 8/1993 Bisceglia ..... B65F 1/06 220/495.09
5,294,017 A * 3/1994 Li ..... B65F 1/004 220/495.07
5,803,299 A 9/1998 Sealy, Jr.
6,102,239 A 8/2000 Wien
6,193,095 B1 * 2/2001 McNeil ..... B65F 1/062 220/495.07
6,808,073 B2 10/2004 Cuisinier
9,045,281 B2 6/2015 Chhina
9,187,241 B2 11/2015 Cohen
2002/0121455 A1 9/2002 Smith et al.
2004/0223664 A1 11/2004 Martin et al.
2007/0235455 A1 10/2007 Goldberg
2009/0012545 A1 * 1/2009 Williamson, IV ..... A61B 17/1285 606/157
2010/0301805 A1 * 12/2010 Sip ..... H02J 7/0044 320/114

* cited by examiner

*Primary Examiner* — Stephen J Castellano
(74) *Attorney, Agent, or Firm* — Altman & Martin; Steven K Martin

(57) ABSTRACT

A self-loading receptacle liner apparatus has a pair of parallel tubes, each with a longitudinal slot extending the length of the tube. The slot center widens to a notch. The tube ends are attached together by two elastic bands with the slots facing each other. Each of a nested set of liners has a drawstring within a passage at the top of the liner and accessible through an opening in the passage. The stacked liners passages are slid into the slot until the drawstring openings align with the notch. The stacked liners are placed in the receptacle, and the tubes pulled apart until they straddle the receptacle opening and placed against the outside of the receptacle. When the upper-most liner is full, the drawstrings are pulled from the notch to cinch the top of the liner, simultaneously pulling the liner from the slots, leaving the next liner ready for use.

2 Claims, 5 Drawing Sheets

SELF-LOADING RECEPTACLE LINER APPARATUS

This application claims the benefit of U.S. provisional application No. 62/796,848 filed 25 Jan. 2019.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to receptacles, more particularly, to devices that automatically replace the liner in a receptacle, such as a trash receptacle, that is being removed.

2. Description of the Related Art

There are many different types of trash receptacles. Typically, they are containers with rectangular open tops.

Liners are available for the receptacles that keep the receptacle clean and make disposing of the trash easier and neater. Liners are well-known in the art. They are typically composed of a rectangular sheet of a flexible polymer that is folded in half and the opposed sides bonded together at seams. The side opposite the fold remains unbonded to provide an opening for depositing trash. The liner is stored flat. An industry-standard liner has a capacity of 13 gallons and, when flat, is 24 inches wide at the opening by 27 inches long at the seams.

Closures are ordinarily provided by drawstrings, twist-ties, or the like. Drawstrings are typically provided by folding the edge of the opening over and bonding it to the body to form a passage in each side. A ribbon is installed in each passage. The ends of the ribbons are bonded into the seams. An aperture in the center of each passage provides access to the ribbon. The ribbons are pulled through the notches to cinch the liner opening.

The liner fits into the receptacle and the edge of the liner drapes over the lip.

Because typical trash receptacles carry only a single liner at a time, it is necessary to replace the liner after it has been filled to capacity. This procedure entails, not only removing the full liner, but installing a new one.

BRIEF SUMMARY OF THE INVENTION

The self-loading receptacle liner apparatus of the present invention has a pair of opposed tubes. Each tube has a longitudinal slot that extends the full length of the tube. The center of the slot widens to a notch on one side of the slot.

The tubes are attached together by an elastic coupler composed of two elastic bands. The ends of one band are attached to the same end of each tube and the ends of the other band are attached to the other end of each tube and arranged so that the slots generally face each other.

A set of liners is installed in the tubes. Each liner has a drawstring that slides within a passage at the top edge of the liner. The drawstring is accessible through an opening in the passage. The liners are nested so that the drawstrings openings are aligned. The section of the stacked liners just below the passage is slid into the slot until the drawstring openings are aligned with the notch. The notch is large enough so that the user is able to grasp the drawstring inside the tube through the notch.

The length of the tubes depends on the size of the liner. A 13-gallon liner fits into a receptacle with an opening that has a total perimeter of approximately 48 inches. How the perimeter is distributed is determined by the length of the sides of the receptacle.

To use, the stacked liners are placed in the receptacle and the tubes are pulled apart until they straddle the receptacle opening and then placed against the outside of the receptacle. The couplers hold the tubes in place against the outside of the receptacle. When the upper-most liner is full, the drawstrings are pulled from the notch to cinch the top of the liner. As the drawstring is pulled, the liner is pulled from the slots and the next liner is ready for use.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
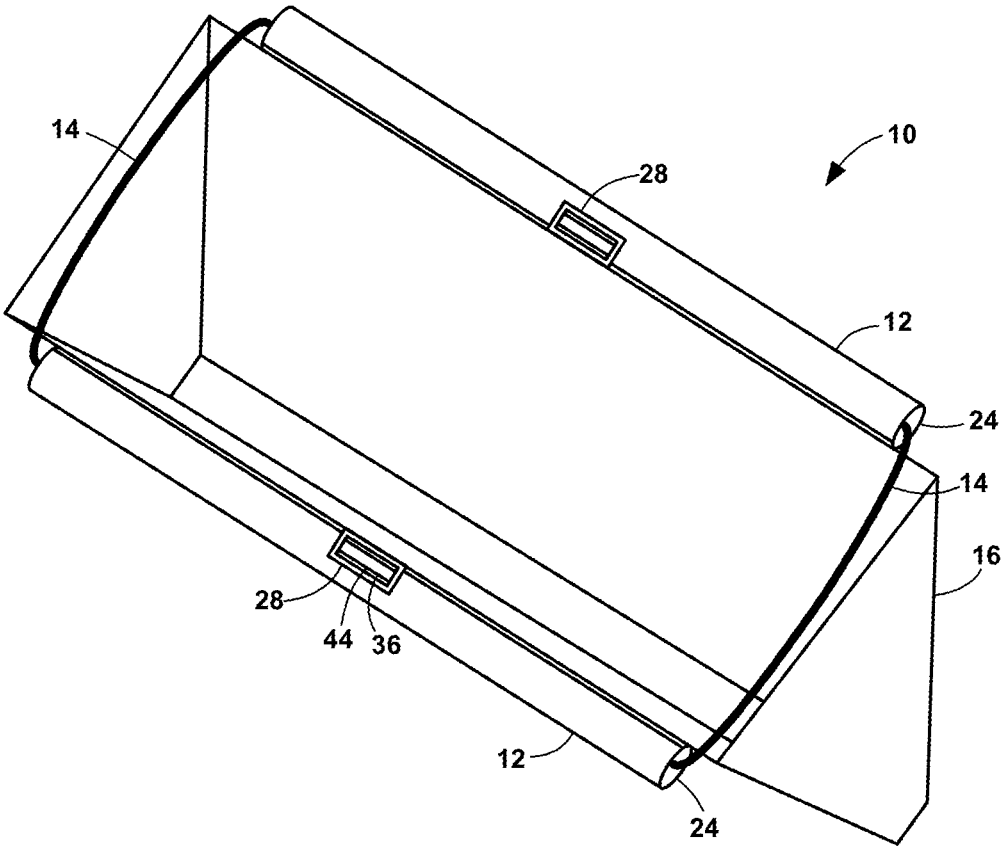
FIG. 1 is a top perspective view of the present invention.
Figure 3:
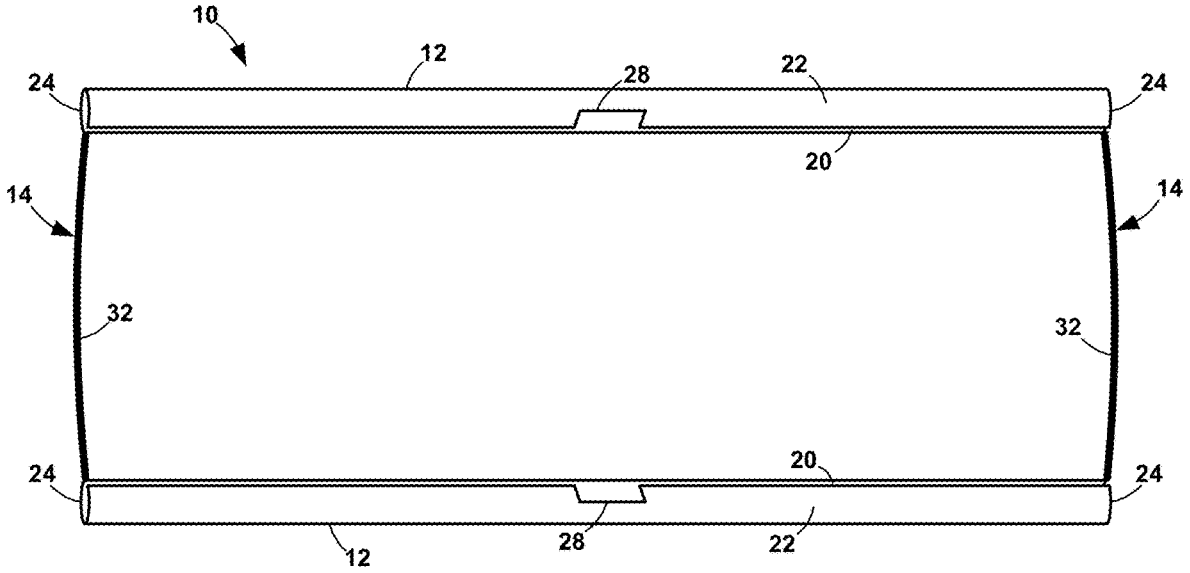
FIG. 3 is a top view of the present invention without liners.

The self-loading receptacle liner apparatus 10 of the present invention has a pair of generally parallel, opposed tubes 12 connected by an elastic coupler 14, as shown in FIGS. 1 and 3. The tubes 12 are elongated pipes made of a rigid material, such as PCV or the like. The two tubes 12 are identical, so only one is described.

Figure 4:
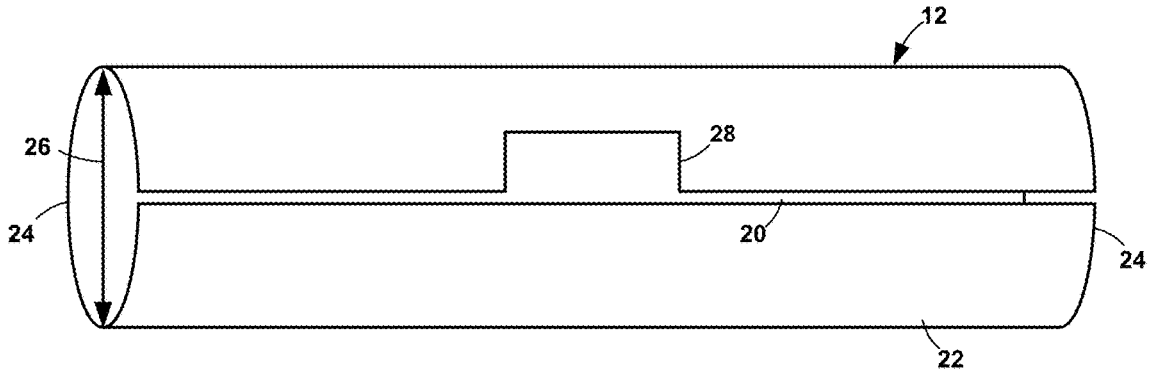
FIG. 4 is side view of a tube with one form of notch.
Figure 5:
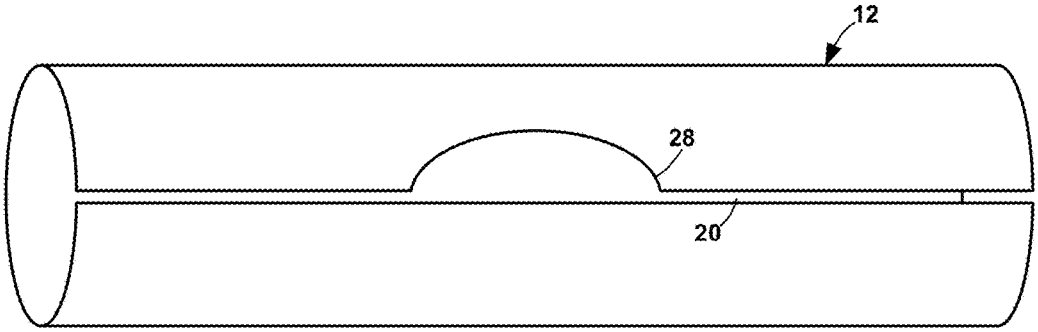
FIG. 5 is side view of a tube with another form of notch.

As shown in FIGS. 4 and 5, the tube 12 has a longitudinal slot 20 in the tube wall 22. The slot 20 extends the full length of the tube 12 so that the slot 20 is open at both ends 24 of the tube 12. The width of the slot 20 is described below. Because of the rigidity of the tube material, the parameters of the slot 20 do not change significantly during use.

In the center of the tube 12, the slot 20 widens to a notch 28 on one side of the slot 20. The notch 28 can be formed as a rectangle, as in FIG. 4, or more rounded, as in FIG. 5.

Figure 6:
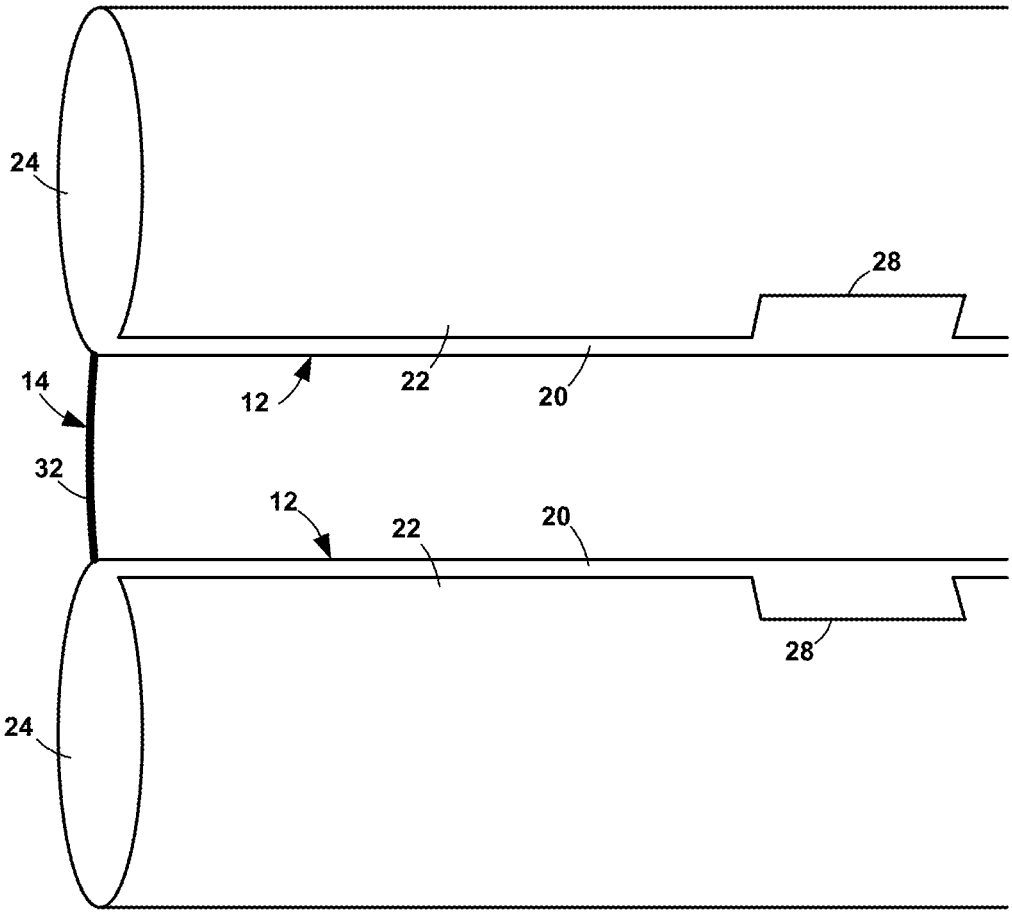
FIG. 6 is a detailed view of the end of the present invention.

The tubes 12 are attached together by a pair of elastic bands 32. The ends of one band 36 are attached to the same end 24 of each tube 12, and the ends of the other band 36 are attached to the other end 24 of each tube 12, as in FIG. 3. The tubes 12 are arranged so that the slots generally face each other, as in FIGS. 3 and 6.

The bands 32 are attached to the tubes 12 in any way that is appropriate. In one example, there is a hole in the side of the tube 12 or in a cap at the end of the tube 12. The band 32 extends through the hole and a knot is tied in the band 32 inside the tube 12. The knot makes the band 32 larger than the hole to prevent the band 32 from being pulled from the hole. Alternatively, the band 32 can be enlarged in other ways, for example, by a globule of adhesive or a collar crimped on the band 32 inside the tube 12.

Figure 7:
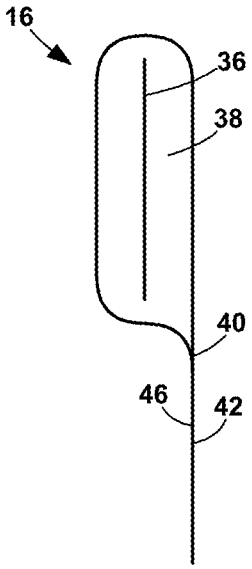
FIG. 7 is an exaggerated cross-sectional view of the top section of a liner.
Figure 8:
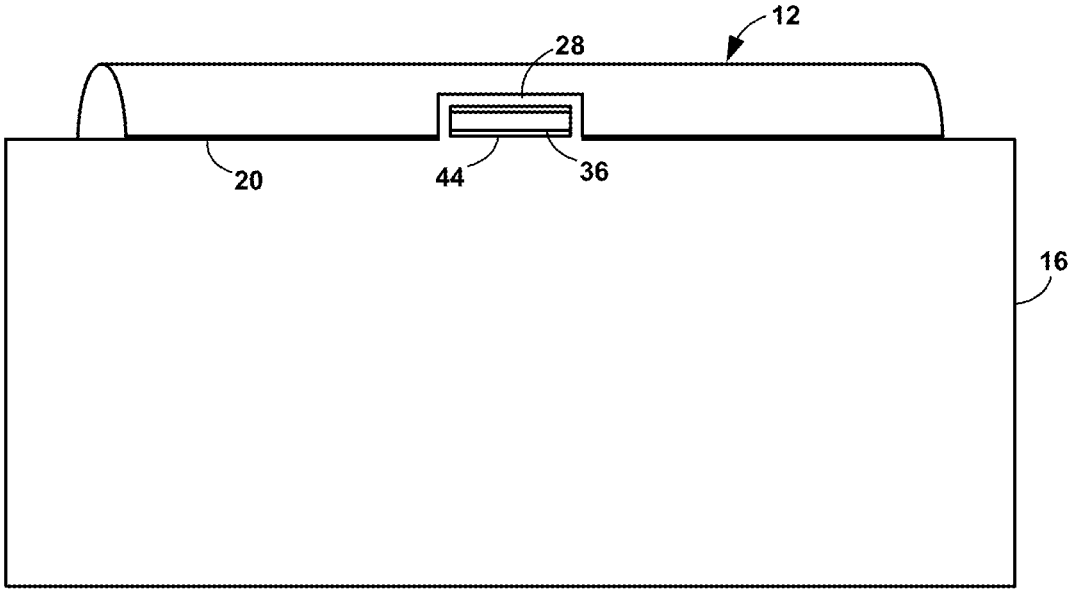
FIG. 8 is a front view of a tube with liners installed.
Figure 9:
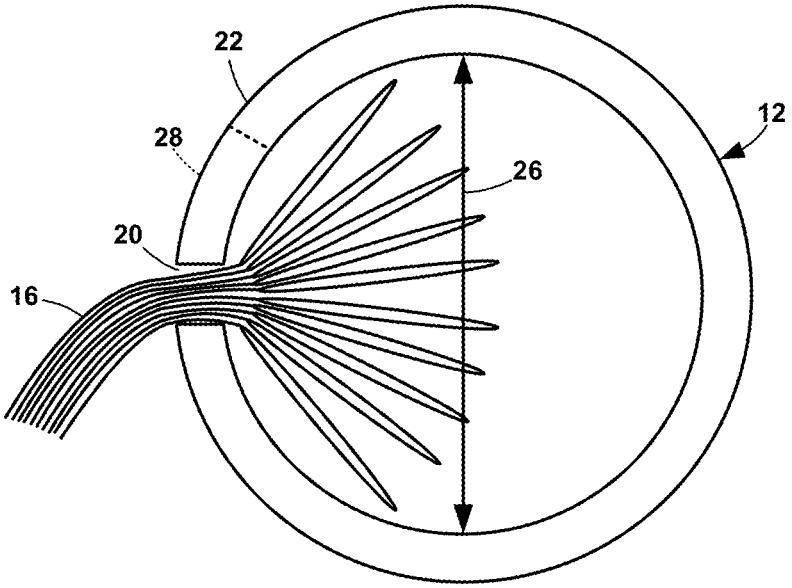
FIG. 9 is a side view of a tube with liners installed.

A set of liners 16 with drawstrings 36 is installed in the tubes 12. As shown in FIG. 7, each liner 16 has a drawstring 36 that slides within a passage 38. Typically, the passage 38 is formed by folding the top edge of the liner 16 over and bonding it to the body 42 of the liner 16 at a seam 40. The drawstring 36 is accessible through an opening 44 in the passage 38.

Figure 2:
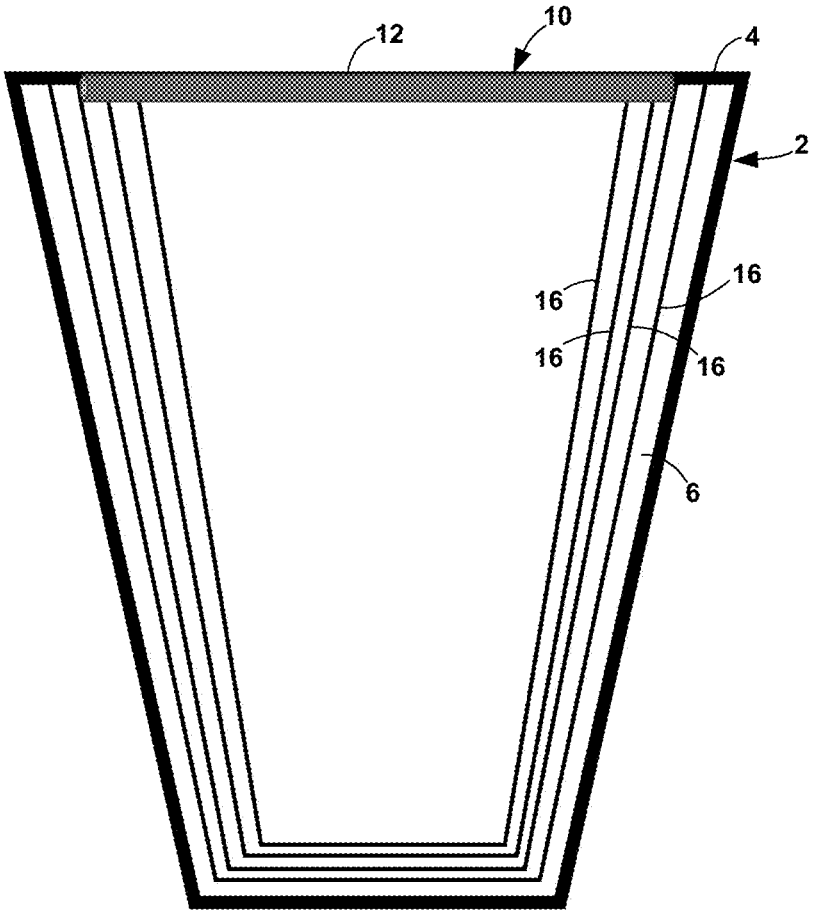
FIG. 2 is a side, cross-sectional view of a trash receptacle with the present invention.

The liners 12 are nested, as in FIG. 2, such that the drawstrings 36 are stacked against each other and the openings 40 are aligned. The neck 46 of the stacked liners 12, that is, the section of the liner 12 at or just below the drawstring passage seam 40, is slid into the slot 20 until the drawstring opening 44 is aligned with the slot notch 28.

The slot 20 must be wide enough to accept the stack of liners 16, but not so wide that the liners 16 can be easily pulled out in a stack. The present invention contemplates that the slot 20 has a constant width along its complete length, except at the notch 28. The present invention also contemplates that the width of the slot 20 can change over its length. For example, the width of the slot 20 can increase slightly from the tube ends 24 to the notch 28.

The inner diameter 26 of the tube 12 must be large enough so that there is enough space in the tube 12 to receive the stacked drawstrings 36.

The length of the tube 12 depends on the size of the liner 16 with which it is being used. The 13-gallon liner 16 described above fits into a receptacle with an opening that has a total perimeter of approximately 48 inches. How the perimeter is distributed is determined by the design of the receptacle. For example, the opening can be square with 12 inches on a side or the opening can be a rectangle with longs sides of 16 inches and short sides of 8 inches or other dimensions that total about 48 inches. The length of the tube 12 should be able to accommodate most receptacles 2 for which the liner 16 can be used. In the current design, the tube 12 is approximately 12 inches long, which is the shortest long dimension of a receptacle with which the 13-gallon liner 16 can be used. The above example can be amended for different size liners 16 and the length of the tube 16 changed accordingly.

The notch 28 must be large enough so that the user is able to grasp the drawstring 36 inside the tube 12. In the current design for 13-gallon liners 16, the notch 28 is 1.5 inches wide along the slot 20 and 1 inch high away from the slot 20. The parameters of the notch 28 can be changed depending on the liners 16 with which the present invention will be used.

To use, the stacked liners 16 are placed in the receptacle 2. The tubes 12 are pulled apart until they straddle the opening 4 of the receptacle 2 and then placed against the outside of the receptacle 2. The couplers 14 pull the tubes 12 toward each other and hold the tubes 12 in place against the outside of the receptacle 2. If the tubes 12 are shorter than the side of the receptacle 2, the couplers 14 extend the rest of the length of the side and around the ends of the receptacle 2.

When the upper-most liner 16 is full, the drawstrings 36 are pulled from the notch 28 to cinch the top of the liner 16. As the drawstring 36 is being pulled, the liner 16 is pulled from the slots 20. When the liner 16 is removed from the receptacle, the next liner 16 of the stack is ready for use. When the last liner 16 is removed, the tubes 12 are pulled apart and removed from around the receptacle 2.

Thus, it has been shown and described a self-loading trash receptacle liner apparatus. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A self-loading receptacle liner apparatus comprising:

(a) a pair of opposed rigid tubes, each tube having ends and a longitudinal slot in the tube wall extending the length of the tube, each slot widening to a notch in the center of the tube, the tubes being arranged such that the slots face each other; and (b) a pair of elastic bands with ends, the ends of each elastic band attached to facing ends of the tubes.

2. The apparatus of claim 1 further comprising a plurality of nested liners, each liner having a drawstring within a passage along the top edge of the liner, the drawstring being accessible through an opening in the passage, the nested liners being installed in the tubes wherein the passages of the liners are within the tubes with the openings aligned with the notches and the remainder of the liners extend outside of the tubes from the slots.

* * * * *